US010993294B2

(12) United States Patent
Morandotti et al.

(10) Patent No.: US 10,993,294 B2
(45) Date of Patent: Apr. 27, 2021

(54) FOOD LOAD COOKING TIME MODULATION

(71) Applicants: WHIRLPOOL CORPORATION, Benton Harbor, MI (US); PANASONIC CORPORATION, Kadoma (JP)

(72) Inventors: Alberto Morandotti, Biandronno (IT); Davide Guatta, Brescia (IT)

(73) Assignees: Whirlpool Corporation, Benton Harbor, MI (US); Panasonic Corporation, Osaka (JP)

( * ) Notice: Subject to any disclaimer, the term of this patent is extended or adjusted under 35 U.S.C. 154(b) by 170 days.

(21) Appl. No.: 16/307,100

(22) PCT Filed: Oct. 19, 2016

(86) PCT No.: PCT/US2016/057682
§ 371 (c)(1),
(2) Date: Dec. 4, 2018

(87) PCT Pub. No.: WO2018/075025
PCT Pub. Date: Apr. 26, 2018

(65) Prior Publication Data

US 2019/0230750 A1 Jul. 25, 2019

(51) Int. Cl.
*H05B 6/68* (2006.01)
*H05B 6/64* (2006.01)
*H05B 6/66* (2006.01)

(52) U.S. Cl.
CPC ..... *H05B 6/687* (2013.01); *H05B 6/647* (2013.01); *H05B 6/668* (2013.01)

(58) Field of Classification Search
CPC .. H05B 6/6435; H05B 6/6438; H05B 6/6485; H05B 6/647; H05B 6/668; H05B 6/687; H05B 1/0263
USPC ..... 219/391, 393, 395, 400, 406, 408, 409, 219/411, 413, 678–681, 685, 702, 720
See application file for complete search history.

(56) References Cited

U.S. PATENT DOCUMENTS

| | | | |
|---|---|---|---|
| 3,536,129 | A | 10/1970 | White |
| 3,603,241 | A | 9/1971 | Drucker |
| 3,835,921 | A | 9/1974 | Faris et al. |
| 4,196,332 | A | 4/1980 | MacKay B et al. |
| 4,210,795 | A | 7/1980 | Lentz |

(Continued)

FOREIGN PATENT DOCUMENTS

| | | | |
|---|---|---|---|
| CN | 103175237 | A | 6/2013 |
| EP | 0550312 | A2 | 7/1993 |

(Continued)

*Primary Examiner* — Hung D Nguyen
(74) *Attorney, Agent, or Firm* — Price Heneveld LLP

(57) ABSTRACT

A cooking system is disclosed. The cooking system is configured to prepare a selected food over a desired time period. The cooking system comprises a controller in communication with a heating apparatus and a user interface. The controller is configured to access a cooking database for the selected food and display a range of available times for the desired time period according to the cooking database. The controller is further operable to receive a selection of the desired time period from the user interface and control the heating apparatus to heat a food load to prepare the selected food to a predetermined quality in the desired time.

20 Claims, 4 Drawing Sheets

(56) References Cited

U.S. PATENT DOCUMENTS

| | | | |
|---|---|---|---|
| 4,374,319 | A | 2/1983 | Guibert |
| 4,481,519 | A | 11/1984 | Margerum |
| 4,777,336 | A | 10/1988 | Asmussen |
| 4,831,239 | A | 5/1989 | Ueda |
| 4,868,357 | A | 9/1989 | Serikawa et al. |
| 4,996,403 | A | 2/1991 | White |
| 5,008,506 | A | 4/1991 | Asmussen et al. |
| 5,094,865 | A | 3/1992 | Levinson |
| 5,293,019 | A | 3/1994 | Lee |
| 5,360,965 | A | 11/1994 | Ishii et al. |
| 5,361,681 | A | 11/1994 | Hedstrom et al. |
| 5,369,253 | A | 11/1994 | Kuwata et al. |
| 5,389,764 | A | 2/1995 | Nishii et al. |
| 5,512,736 | A | 4/1996 | Kang et al. |
| 5,521,360 | A | 5/1996 | Johnson et al. |
| 5,632,921 | A | 5/1997 | Risman et al. |
| 5,648,038 | A | 7/1997 | Fathi et al. |
| 5,681,496 | A | 10/1997 | Brownlow et al. |
| 5,756,970 | A | 5/1998 | Barger et al. |
| 5,828,042 | A | 10/1998 | Choi et al. |
| 5,961,871 | A | 10/1999 | Bible et al. |
| 6,034,363 | A | 3/2000 | Barmatz et al. |
| 6,066,838 | A | 5/2000 | Koda et al. |
| 6,150,645 | A | 11/2000 | Lewis et al. |
| 6,172,348 | B1 | 1/2001 | Yoshino et al. |
| 6,559,882 | B1 | 5/2003 | Kerchner |
| 6,884,979 | B1 | 4/2005 | Torngren et al. |
| 7,105,787 | B2 | 9/2006 | Clemen, Jr. |
| 7,111,247 | B2 | 9/2006 | Choi et al. |
| 7,191,698 | B2 | 3/2007 | Bond et al. |
| 7,326,888 | B2 | 2/2008 | Chun et al. |
| 7,461,588 | B2 | 12/2008 | Head |
| 7,501,608 | B2 | 3/2009 | Hallgren et al. |
| 7,923,664 | B2 | 4/2011 | Kruempelmann et al. |
| 7,992,552 | B2 | 8/2011 | Hirano et al. |
| 3,207,479 | A1 | 6/2012 | Ben-Shmuel et al. |
| 8,218,402 | B2 | 7/2012 | Lewis et al. |
| 8,283,605 | B2 | 10/2012 | Arione et al. |
| 8,324,540 | B2 | 12/2012 | Nordh et al. |
| 8,330,085 | B2 | 12/2012 | Ishizaki et al. |
| 8,338,763 | B2 | 12/2012 | Nordh et al. |
| 8,389,916 | B2 | 3/2013 | Ben-Shmuel et al. |
| 8,610,038 | B2 | 12/2013 | Hyde et al. |
| 8,742,305 | B2 | 6/2014 | Simunovic et al. |
| 8,742,306 | B2 | 6/2014 | Atzmony et al. |
| 8,839,527 | B2 | 9/2014 | Ben-Shmuel et al. |
| 8,922,969 | B2 | 12/2014 | Sigalov et al. |
| 8,927,913 | B2 | 1/2015 | Hyde et al. |
| 9,035,224 | B2 | 5/2015 | Lim et al. |
| 9,040,879 | B2 | 5/2015 | Libman et al. |
| 9,078,298 | B2 | 7/2015 | Ben-Shmuel et al. |
| 9,131,543 | B2 | 9/2015 | Ben-Shmuel et al. |
| 9,132,408 | B2 | 9/2015 | Einziger et al. |
| 9,161,390 | B2 | 10/2015 | Gelbart et al. |
| 9,161,394 | B2 | 10/2015 | Carlsson et al. |
| 9,167,633 | B2 | 10/2015 | Ben-Shmuel et al. |
| 9,182,126 | B2 | 11/2015 | Cartwright et al. |
| 9,210,740 | B2 | 12/2015 | Libman et al. |
| 9,215,756 | B2 | 12/2015 | Bilchinsky et al. |
| 9,301,344 | B2 | 3/2016 | Ibragimov et al. |
| 9,307,583 | B2 | 4/2016 | Sim et al. |
| 9,332,591 | B2 | 5/2016 | Libman et al. |
| 9,351,347 | B2 | 5/2016 | Torres et al. |
| 9,363,852 | B2 | 6/2016 | Carlsson et al. |
| 9,363,854 | B2 | 6/2016 | Sim et al. |
| 9,374,852 | B2 | 6/2016 | Bilchinsky et al. |
| 9,398,644 | B2 | 7/2016 | Okajima |
| 9,398,646 | B2 | 7/2016 | Nobue et al. |
| 9,414,444 | B2 | 8/2016 | Libman et al. |
| 9,459,346 | B2 | 10/2016 | Einziger et al. |
| 9,462,635 | B2 | 10/2016 | Bilchinsky et al. |
| 9,462,642 | B2 | 10/2016 | Chu et al. |
| 2003/0070799 | A1 | 4/2003 | Mueller et al. |
| 2006/0191926 | A1 | 8/2006 | Ray et al. |
| 2008/0105675 | A1 | 5/2008 | Choi et al. |
| 2008/0297208 | A1 | 12/2008 | Baudin et al. |
| 2009/0011101 | A1 | 1/2009 | Doherty et al. |
| 2009/0236333 | A1 | 9/2009 | Ben-Shmuel et al. |
| 2009/0321428 | A1 | 12/2009 | Hyde et al. |
| 2010/0059509 | A1 | 3/2010 | Imai et al. |
| 2010/0176121 | A1 | 7/2010 | Nobue et al. |
| 2010/0176123 | A1 | 7/2010 | Mihara et al. |
| 2010/0182136 | A1 | 7/2010 | Pryor |
| 2010/0187224 | A1 | 7/2010 | Hyde et al. |
| 2010/0231506 | A1 | 9/2010 | Pryor |
| 2011/0139773 | A1 | 6/2011 | Fagrell et al. |
| 2012/0067873 | A1 | 3/2012 | Mihara et al. |
| 2012/0103972 | A1 | 5/2012 | Okajima |
| 2012/0103973 | A1 | 5/2012 | Rogers et al. |
| 2012/0168645 | A1 | 7/2012 | Atzmony et al. |
| 2012/0312801 | A1 | 12/2012 | Bilchinsky et al. |
| 2013/0048881 | A1 | 2/2013 | Einziger et al. |
| 2013/0056460 | A1 | 3/2013 | Ben-Shmuel et al. |
| 2013/0080098 | A1 | 3/2013 | Hadad et al. |
| 2013/0092033 | A1* | 4/2013 | Murphy ..... F24C 7/086 99/342 |
| 2013/0142923 | A1 | 6/2013 | Torres et al. |
| 2013/0146590 | A1 | 6/2013 | Einziger et al. |
| 2013/0186887 | A1 | 7/2013 | Hallgren et al. |
| 2013/0206752 | A1 | 8/2013 | Moon et al. |
| 2013/0240757 | A1 | 9/2013 | Einziger et al. |
| 2013/0334215 | A1 | 12/2013 | Chen et al. |
| 2014/0203012 | A1 | 7/2014 | Corona et al. |
| 2014/0287100 | A1 | 9/2014 | Libman |
| 2014/0305934 | A1 | 10/2014 | DeCamillis et al. |
| 2015/0070029 | A1 | 3/2015 | Libman et al. |
| 2015/0136760 | A1 | 5/2015 | Lima et al. |
| 2015/0156823 | A1 | 6/2015 | Okajima |
| 2015/0156827 | A1 | 6/2015 | Ibragimov et al. |
| 2015/0271877 | A1 | 9/2015 | Johansson |
| 2015/0346335 | A1 | 12/2015 | Einziger et al. |
| 2015/0366006 | A1 | 12/2015 | Ben-Shmuel et al. |
| 2016/0073453 | A1 | 3/2016 | Hyde et al. |
| 2016/0095171 | A1 | 3/2016 | Chaimov et al. |
| 2016/0128138 | A1 | 5/2016 | Li et al. |
| 2016/0205973 | A1 | 7/2016 | An et al. |
| 2016/0249416 | A1 | 8/2016 | Elboim et al. |
| 2016/0273970 | A1 | 9/2016 | Alon et al. |
| 2016/0278170 | A1 | 9/2016 | Atherton et al. |
| 2016/0323940 | A1 | 11/2016 | Guatta |
| 2016/0330803 | A1 | 11/2016 | Guatta |

FOREIGN PATENT DOCUMENTS

| | | | |
|---|---|---|---|
| EP | 1076475 | A2 | 2/2001 |
| EP | 1193584 | A1 | 4/2002 |
| EP | 1471773 | A2 | 10/2004 |
| EP | 1795814 | A2 | 6/2007 |
| EP | 2051564 | A2 | 4/2009 |
| EP | 2512206 | A1 | 10/2012 |
| EP | 2824991 | A1 | 1/2015 |
| EP | 2446703 | B1 | 4/2015 |
| EP | 2446704 | B1 | 4/2015 |
| EP | 2446705 | B1 | 4/2015 |
| EP | 2906021 | A1 | 8/2015 |
| EP | 2916619 | A1 | 9/2015 |
| EP | 2446706 | B1 | 1/2016 |
| EP | 2205043 | B1 | 1/2017 |
| EP | 2239994 | B1 | 11/2018 |
| FR | 2766272 | A1 | 1/1999 |
| GB | 2193619 | A | 2/1988 |
| RU | 2253193 | C2 | 5/2005 |
| WO | 9107069 | | 5/1991 |
| WO | 9913688 | | 3/1999 |
| WO | 0036880 | | 6/2000 |
| WO | 0223953 | A1 | 3/2002 |
| WO | 2008018466 | A1 | 2/2008 |
| WO | 2010052724 | A2 | 5/2010 |
| WO | 2011058537 | A1 | 5/2011 |
| WO | 2011108016 | A1 | 9/2011 |
| WO | 2011138675 | A2 | 11/2011 |
| WO | 2011138688 | A2 | 11/2011 |
| WO | 2012052894 | A1 | 4/2012 |
| WO | 2012162072 | A1 | 11/2012 |

(56) References Cited

FOREIGN PATENT DOCUMENTS

| | | | |
|---|---|---|---|
| WO | 2013059084 | A1 | 4/2013 |
| WO | 2013078325 | A1 | 5/2013 |
| WO | 2014006510 | A2 | 1/2014 |
| WO | 2014024044 | A1 | 2/2014 |
| WO | 2015099651 | A1 | 7/2015 |
| WO | 2015127999 | A1 | 9/2015 |
| WO | 2016144872 | A1 | 9/2016 |

* cited by examiner

FOOD LOAD COOKING TIME MODULATION

TECHNOLOGICAL FIELD

This application relates to methods and systems for food preparation, and more specifically to methods and systems for heating food.

SUMMARY

In at least one aspect, a cooking system is disclosed. The cooking system is configured to prepare a selected food over a desired time period. The cooking system comprises a controller in communication with a heating apparatus and a user interface. The controller is configured to access a cooking database for the selected food and display a range of available times for the desired time period according to the cooking database. The controller is further operable to receive a selection of the desired time period from the user interface and control the heating apparatus to heat a food load to prepare the selected food to a predetermined quality in the desired time.

In at least another aspect, a method for heating a food over a desired time period is disclosed. The method comprises receiving a selected food type from a plurality of food types and receiving a desired cook time for preparation of the selected food type. The method further comprises comparing the desired cook time to a range of available cook times and controlling a heating apparatus to heat a food load corresponding to the selected food type to a predetermined quality level in the desired cook time.

In at least another aspect, a cooking system is disclosed. The cooking system is configured to prepare a selected food over a desired time period. The heating system comprises a controller a controller in communication with a heating apparatus and a user interface. The controller is configured to receive a selection of a selected food identifying a food load and receive the desired time period from the user interface. The controller is further configured to access a cooking database comprising a plurality of food types based on the selection and compare the desired time period to a range of available times indicated in the cooking database. The available times are predetermined to prepare the food load to a minimum quality level. The controller is further configured to control the heating apparatus to heat the food load and prepare the selected food to at least the minimum quality level in the desired time.

These and other features, advantages, and objects of the present device will be further understood and appreciated by those skilled in the art upon studying the following specification, claims, and appended drawings.

DETAILED DESCRIPTION OF EMBODIMENTS

Figure 1:
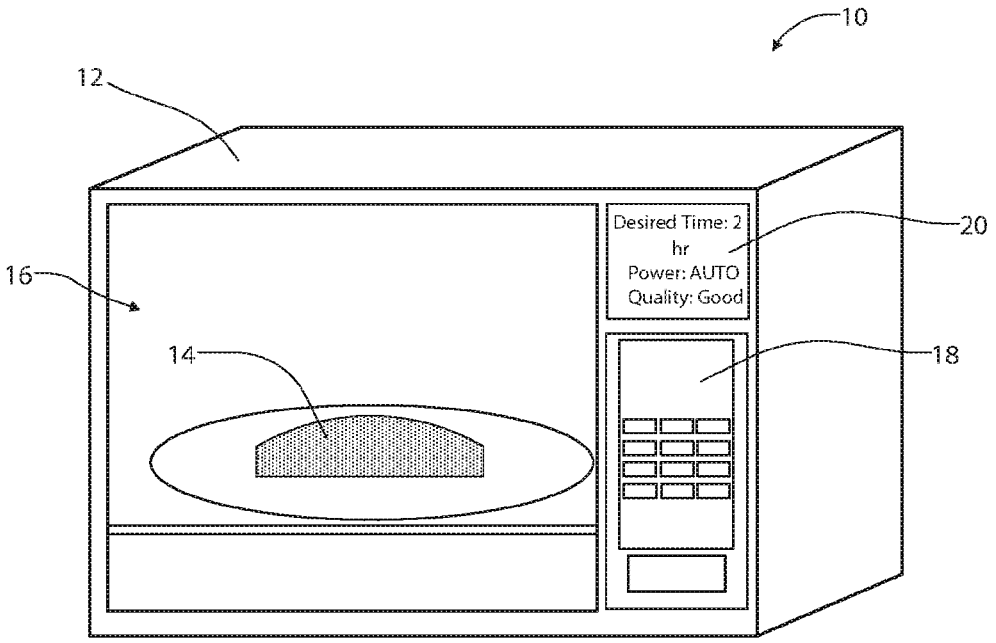
FIG. 1 is a schematic diagram of a cooking system configured to modulate a cooking time.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to FIG. 1, a schematic diagram of a cooking system 10 is shown. The cooking system 10 may comprise various forms or combinations of cooking apparatuses. For example, the cooking apparatus 12 of the cooking system 10 may correspond to a microwave, broiler (toaster) oven, convection oven, or any combination of similar devices that may be configured to heat a food load 14 in a heating cavity 16. The cooking system 10 may comprise a user interface 18 operable to receive various inputs to control one or more cooking operations. The user interface 18 may comprise a display 20 configured to communicate one or more instructions, status identifiers, settings, soft keys, and/or various forms of graphical information.

In some embodiments, the cooking system 10 may be configured to access and perform a programmed or automated cooking function. Such a function may correspond to a timed cooking routine configured to prepare the food load 14 to a desired or predetermined level of quality. The predetermined level of quality as discussed herein may refer to various cooking characteristics (e.g. internal temperature, moisture, browning, etc.). In some embodiments, the cooking system 10 may provide for an improved process for heating the food load 14. For example, rather than requesting a manual entry of a cook time or automatically providing a cook time for a cooking program, the cooking system 10 may be operable to prepare the food load 14 over a desired time or user requested time while ensuring that the food is prepared to the predetermined level of quality.

In some embodiments, the predetermined level of quality for a particular food type may be derived from similar food type. For example, the cooking system may comprise a database or library of experimental data describing the response characteristics of each food type. However, test results for some food types may be derived from or interpolated from experimental results measured for other, related food types. In particular, an acceptability curve, such as that later discussed in reference to FIGS. 3 and 4, may be similar for most forms of boneless red meat. Similarly, such a curve may be similar for various breads or grains. Accordingly, the experimental data and the corresponding acceptability curves may be effectively utilized to similar food types while maintaining a predetermined quality level for the preparation. One benefit of utilizing similar acceptability curves for related food types may include a reduction in memory necessary to store the acceptability curves and related data.

In general, cooking time for a cooking device may be associated with the amount of energy that has to be provided to a food load. Depending on the food type, portion, preparation method, desired temperature, and/or recipe, the amount of energy required and a cooking power or rate of cooking provided by one or more heat sources may vary. Accordingly, a conventional heating process may utilize a preconfigured cooking environment to prepare a selected food type and corresponding portion to a cook time that is also preconfigured. In this way, a conventional cooking device may provide a cook time for a food type. Accordingly, while a conventional cooking device may provide for an automated cooking process, there is little flexibility to adjust a time period over which a food load is prepared. In such systems a change in a time period will result in a different cooking result of the food load.

Additionally, some cooking devices may provide for delayed cooking functions. However, such functions may simply delay a cooking start time rather than adjust the cooking time. A drawback of such devices is that delayed cooking functions require food items to be left at ambient temperature waiting for the cooking process to start. Accordingly, these systems may lead to food spoilage and/or risks of foodborne poisoning. For these reasons, such systems may be of limited value.

The cooking system 10 may provide for a control scheme that utilizes a predetermined level of quality as the automated setting for preparation of the food load 14. Based on the level of quality desired for the food load 14, a controller of the cooking system 10 may calculate a range of cooking times and corresponding power levels or cooking routines to prepare the food load 14 to the desired quality level. In this way, the cooking system 10 may provide for a user or operator to select a desired time to prepare the food load 14. If the desired time is within a time range for the desired quality level, the desired time may be utilized to prepare the food load 14.

For example, when initiating a cooking operation, a user may activate a time accommodating or time modulating cooking program. The program may be activated in response to an input to the cooking system 10 via the user interface 18. In response to the activation of the program, the system 10 may prompt the user for information identifying the food load 14 on a display screen 20. The information requested may include a food category (e.g. meats, vegetables, grains, etc.), a specific food type (chicken breast, green beans, pizza, etc.), and a proportion of the food load (e.g. weight, mass, volume, quantity, etc.). The requested information may additionally indicate various properties of the food load 14 such as a starting temperature (e.g. frozen, chilled, room temperature, etc.). Though described as being input by a user, the information describing the food load 14 may also be identified by one or more sensors (e.g. imagers, light sensors, scales, pressure sensors, and a variety of transducers) that may be incorporated with the cooking system 10.

Figure 2:
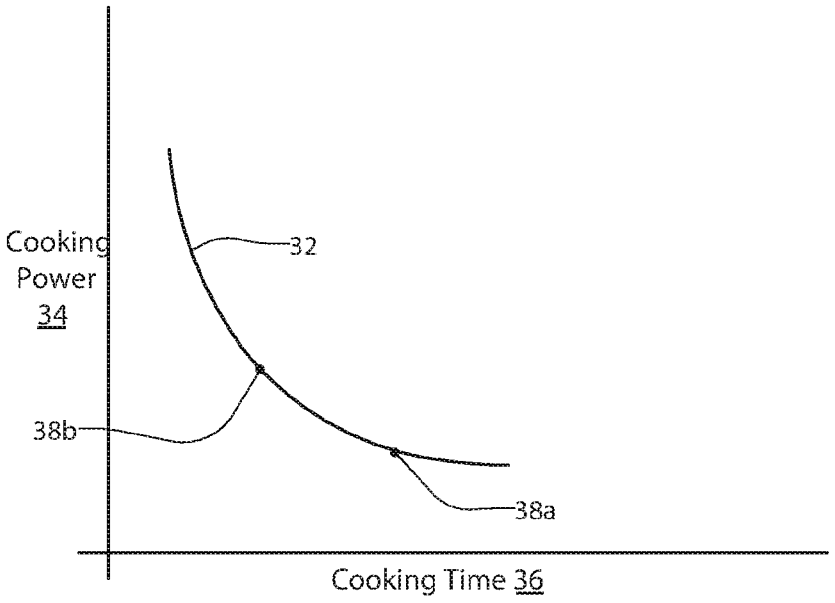
FIG. 2 is a graph demonstrating the inverse relationship between a cooking power and a cooking time for a cooking device.

Referring now to FIG. 2, an example of a quality curve 32 for a food type is shown demonstrating an inverse relationship between a cooking power 34 and a cooking time 36 for a specified food type. The quality curve 32 may demonstrate a first cook time 38*a* and a second cook time 38*b*. The first cook time 38*a* and the second cook time 38*b* may correspond to different cooking times 36 and corresponding cooking powers 34 required for the food type to reach a desired temperature or quality parameter. As illustrated, the quality curve 32 may demonstrate a range of cooking times 36 over which a specific food load may be prepared to a desired temperature. However, the quality curve 32 may have limited accuracy due to a complexity of biochemical and thermophysical phenomena that occur in food matter when heated by a cooking device (e.g. cooking system 10). For this reason, it may be desirable to establish a spectrum of variations of cooking powers 34 and cooking times 36 in order to indicate that a specific food type is prepare to a desired level of quality.

Figure 3:
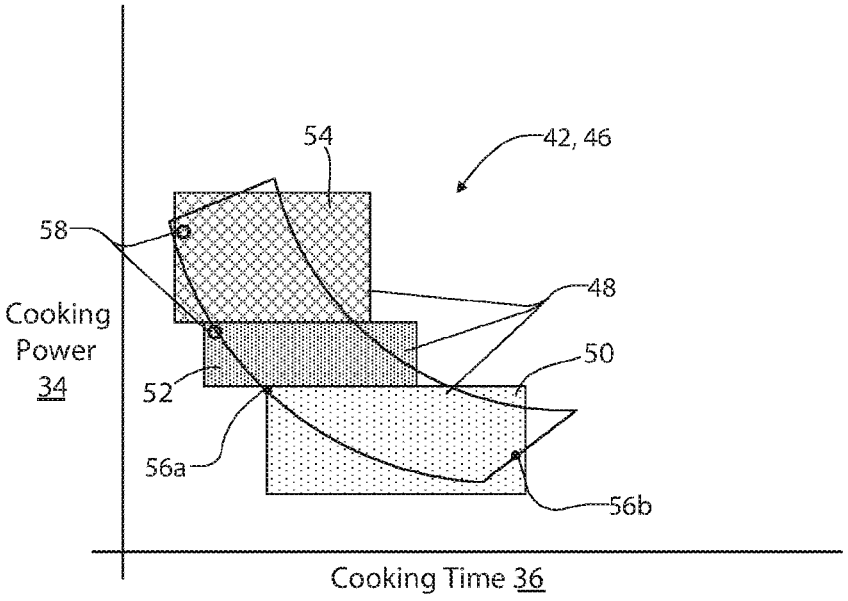
FIG. 3 is a graph demonstrating an acceptability curve of a food type.
Figure 4:
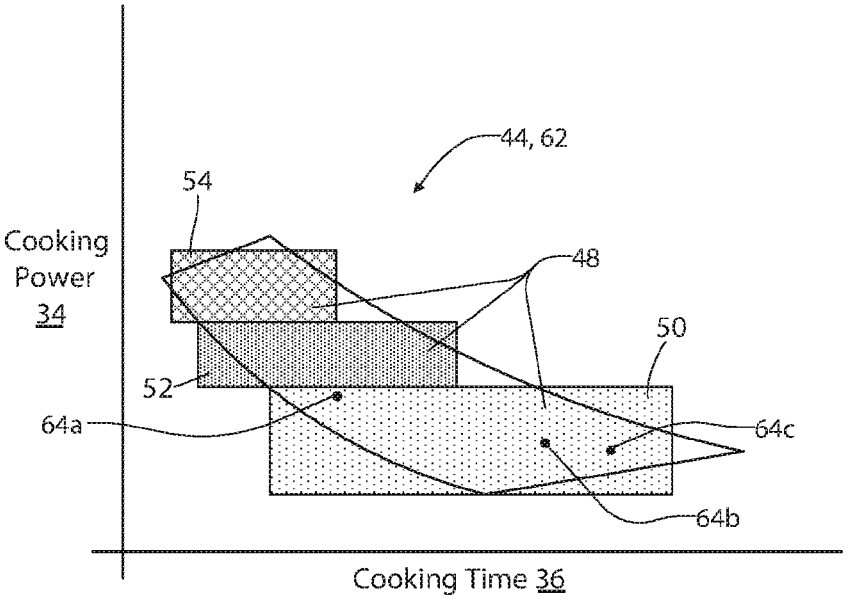
FIG. 4 is a graph demonstrating an acceptability curve of a food type.

Referring now to FIGS. 3 and 4, acceptability curves 46 and 62 are shown demonstrating a range of the cooking powers 34 and cooking times 36 for first food type 42 and a second food type 44. For example, in FIG. 3, a first acceptability curve 46 may demonstrate a range of available cooking times 36 for each cooking power 34 of the cooking apparatus 12. Additionally, a quality parameter 48 may be assigned to different portions of the acceptability curve 46. In this way, a controller of the cooking system 10 may vary a cooking time 36 of the first food type 42 while maintaining a desired or predetermined quality parameter 48. Accordingly, the cooking system 10 may control the cooking apparatus 12 to prepare the first food type 42 to have a desired preparation quality while varying the cooking time 36.

The quality parameters 48 may include various indications or designations of relative quality corresponding to each food type. The food types and corresponding quality levels may be stored in a local memory or remote server that may be accessed by a controller of the cooking system 10 to automate a preparation process for a specified food load 14. For example, the quality parameters 48 may include a first quality level 50, a second quality level 52 and third quality level 54. Each of the quality parameters 48 may be assigned to a portion of the acceptability curve 46 and may correspond to cooking results for a food type (e.g. the first food type 42) that may be considered acceptable from a sensory standpoint and a hygienic perspective. The metrics utilized to indicate that the cooking results correspond to a quality parameter 48 may include a variety of properties of each food type that may be prepared by the cooking system 10.

For example, the quality parameters 48 may be assigned based on data gathered for each of the food types that may have acceptability curves accessible to the cooking system 10. The metrics may include but are not limited to a desired temperature, moisture level, browning level or crispness, consistency, and/or various additional properties that may be identified by acceptability curves for each of the various food types. Accordingly, the metrics may be utilized to indicate the quality parameters 48 for each food type based on sensory attributes of consumers utilizing the cooking system 10. In this configuration, each of the acceptability curves may be configured to indicate a range of cooking powers 34 and cooking times 44 that may provide consistent results conforming to a desired quality level.

As illustrated in FIG. 3, each of the quality levels 50, 52, and 54 for the first food type 42 may correspond to specific ranges of cooking times 36 and cooking powers 34. Additionally, cooking times 36 and cooking powers 34 that are not included in the boundaries of the quality levels 50, 52, and 54 may correspond to unacceptable quality levels that the controller of the cooking system may restrict from programming for the first food type 42 in this example or similarly for various food types as discussed herein. Though some variation in the cooking results within the range of cooking times and temperatures for each of the first quality level 50, the second quality level 52, and the third quality level 54 may exist, the perceived quality within each of quality parameters 48 may be similar from a sensory standpoint. Accordingly, the cooking system 10 may utilize a plurality of cooking algorithms or acceptability curves corresponding to various food types to prepare each of the food types through an automated cooking operation. Additionally, automated cooking operation may be completed while providing for a user configurable cooking time to select a cooking duration of each cooking operation.

The first quality level 50 may correspond to a good, high, and/or optimum quality level. In an exemplary embodiment, preparation of a selected food type within the cooking power 34 and cooking time 36 parameters of the first quality level 50 may provide for a resulting preparation of the first food type 42 within a predefined range of temperatures, moisture levels, crispness or browning levels, and/or various other quality measures for the first food type 42. Accordingly, the cooking system 10 may be configured to receive a first cooking time 56*a* or a second cooking time 56*b* and adjust the cooking power 34 such that the first food type 42 is prepared to the first quality level 50 over either of the cooking times 56*a* and 56*b*.

In some embodiments, the cooking system 10 may provide for a food type (e.g. the first food type 42) to be prepared at the second quality parameter 52 or the third quality parameter 54 while varying the cooking time 36 within the corresponding cooking powers 34 as illustrated in FIG. 3. For example, the cooking system 10 may be configured to receive a desired cooking time 58 located in the second quality level 52 or the third quality level 54. In response to such a request, the controller of the cooking system 10 may output an indication, prompt, or warning indicating that the desired cooking time 58 is outside the first quality level 50. For example, the controller may indicate on the display screen that the desired cooking time 58 corresponds to the second quality level 52 or the third quality level 54. Additionally, the controller may be configured to request a confirmation of the desired cooking time 58 prior to preparing the food load at the second quality level 52 or the third quality level 54. In this configuration, the cooking system may provide for decreased cooking times for the food load 14 while notifying a user that the quality parameter 48 may be decreased for the desired cooking time 58.

The cooking system 10 may adjust the cooking power 34 in various ways, some of which may depend on the specific configuration of the cooking apparatus 12. Various configurations of the cooking apparatus 12 are further discussed in reference to FIG. 6. For example, the controller of the cooking system 10 may selectively control a power level of a microwave element, a set temperature of a heating element, a duty cycle of a heating element, or various other attributes of the cooking apparatus 12. In this way, the disclosure may provide for a variety of embodiments that may be configured to provide for time modulated cooking of various food types to pre-configured quality levels to suit a wide variety of applications.

In some embodiments, the cooking system 10 may provide for a user to adjust a cooking time after a cooking operation has already begun. For example, if a user of the cooking system 10 wishes to adjust a selected cooking time similar to those discussed in reference to FIG. 3, the controller of the cooking system 10 may provide an updated range of cooking times for the food type such that the cooking time is extended or decreased per a user's request. When calculating the extended or decreased cook time, the cooking system may modulate a rate of energy transfer from one or more of the heating sources of the cooking apparatus 12. In this way, the cooking system 10 may be configured to adjust a first requested cook time to a second requested cook time while maintaining the quality parameter 48 selected for the specific preparation.

Referring now to FIG. 4, an acceptability curve 62 for the second food type 44 is shown. Similar to the acceptability curve 46, the acceptability curve 62 also comprises quality parameters 48 indicating the first quality level 50, the second quality level 52 and the third quality level 54. Though the specific boundaries of the quality parameters 48 may differ for the first food type 42 and the second food type 44, similar terms and reference numerals may be used for clarity.

As previously discussed, in some embodiments, the cooking system 10 may be configured to begin cooking a food load 14 to a specified or predetermined quality level over a user indicated cooking time 36. As an example, a first requested cooking time 64*a* is demonstrated in the acceptability curve 62 specifying a relatively short duration for the cooking time 36. Once the cooking operation has started, the heat transfer into the food load 14 from the cooking apparatus 12 may be partially completed. However, the cooking system 10 may allow for the user to interrupt and/or adjust the first requested cooking time 64*a* to a second requested cooking time 64*b*. In the example shown in FIG. 4, the second requested cooking time 64*b* has an extended duration; however, the second requested cooking time 64*b* may similarly correspond to a decreased cooking time.

When adjusting the cooking operation from the first requested cooking time 64*a* ($T_1$) to the second requested cooking time 64*b* ($T_2$) the controller of the cooking system 10 may adjust or modulate the rate of energy transfer from the cooking apparatus 12 into the food load 14. For example, the controller may account for monitor or track a quantity of heat transferred into the food load 14 during operation and prior to the interruption. In order to accommodate the second requested cooking time 64*b*, the controller may calculate a completed time ($T_C$) prior to the interruption and a remaining time after the interruption. By comparing the completed time and the remaining time, the controller may scale the reference time for the acceptability curve 62 to a proportionate amount of the completed time ($T_C$) from the second requested cooking time 64*b* ($T_2$). In this way, the cooking system 10 may determine a reference time ($T_R$) to utilize to determine the power setting for the adjusted cooking time. The equation for the reference time ($T_R$) is shown as Eq. 1.

$$T_R = T_2 \div (1 - T_C/T_1)$$

For example, if the first requested cooking time 64*a* ($T_1$) is 10 minutes and 2 minutes have elapsed before the interruption, the remaining cooking time for the first cooking power 34 would be 8 minutes. However, if the second requested cooking time 64*b* ($T_2$) is 20 minutes, the controller of the cooking apparatus 10 must account for the elapsed time. Based on Eq. 1, the reference time 64*c* ($T_R$) may be determined to be 25 minutes. Accordingly, the controller may utilize a cooking power 34 corresponding the reference time 64*c* ($T_R$) with a remaining cook time of 20 minutes to achieve the second requested cooking time 64*b*. In this way, the controller may adjust the cooking time based on the data of the acceptability curve 62.

Though a specific method is discussed, the determination of the reference time 64*c* ($T_R$) may be accomplished via a plurality of methods. In general, the objective of the reference time and corresponding cooking power 34 may be to ensure the amount of energy delivered to the food load 14 is maintained for each of the first requested cooking time 64*a* and the second requested cooking time 64*b*. The total energy delivered to the food load may be related to the integral of the cooking power 34 over the cooking time 36. Accordingly, various methods of interpolation may be utilized to determine the reference time 64*c* ($T_R$).

Additionally in some embodiments, the cooking system 10 may comprise one or more sensors configured to detect properties of the cooking results for the food load 14 in real time. For example, the cooking system 10 may monitor a temperature of the food load by utilizing a thermal sensor, a browning level or crispness by utilizing an imager, and/or a moisture level by utilizing a humidistat. Based on this information, the controller of the cooking system 10 may manipulate the acceptability curve 62 and the quality parameters 48 to predict the cooking power 34 and cooking methods. In this way, the cooking system 10 may provide for a user selected cooking time throughout a cooking operation such that the cooking process for each of a variety of food types may be adjusted.

Figure 5:
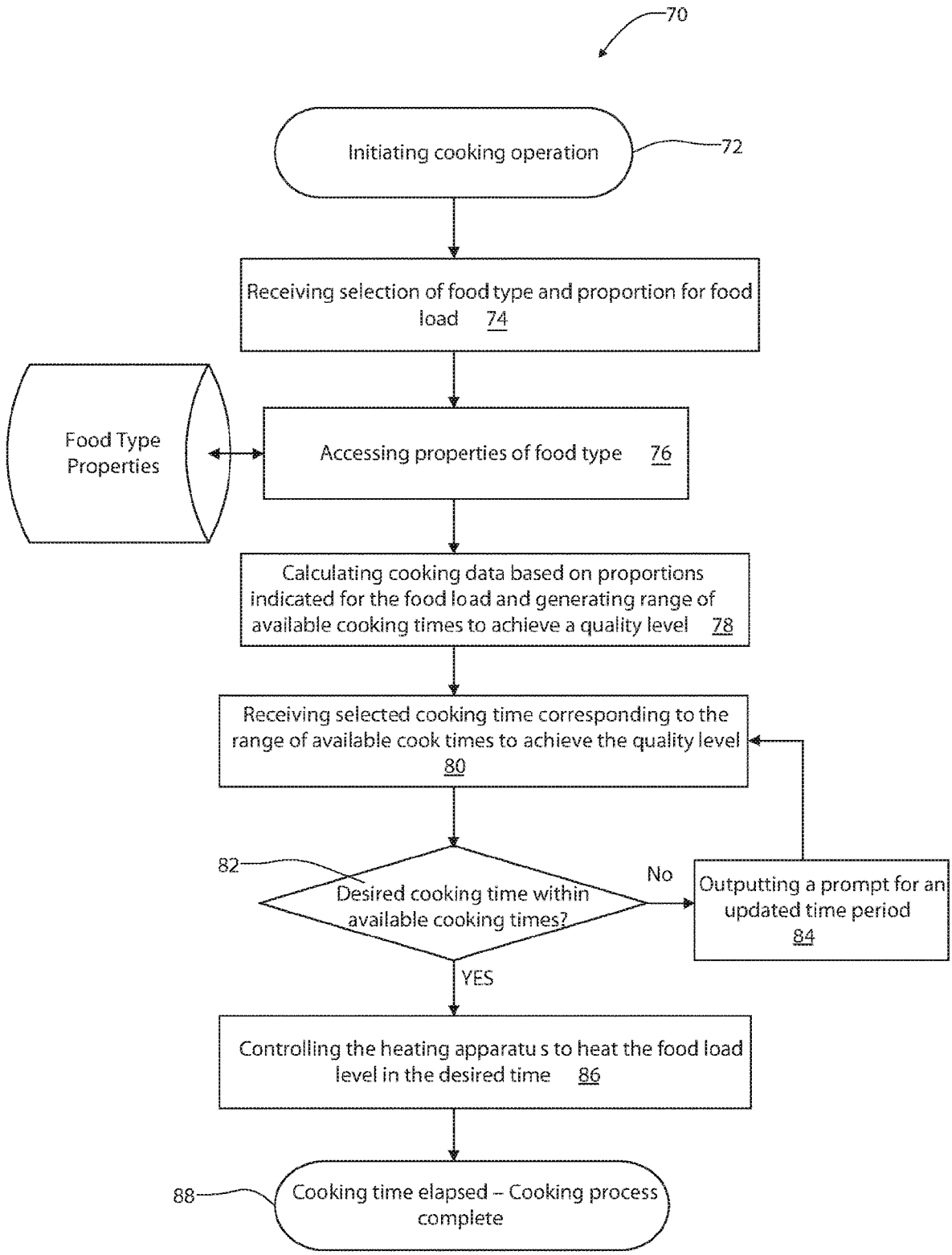
FIG. 5 is a flow chart demonstrating a cooking operation with a user-configurable cooking time.

Referring now to FIG. 5, a method 70 for a cooking operation with a user configurable cook time is shown. The method 70 may begin by initiating the cooking operation 72. The cooking operation may be initiated in response to a controller of the cooking system 10 receiving a selection of a food type and a proportion of the food load 14 (74). The selection of the food type and the proportions for the food load 14 may be received by the controller via the user interface 18. Additionally, the controller may prompt a user of the cooking system 10 to input or correct information input into the cooking system 10 by displaying information on the display screen 20.

Based on the selection of the food type and proportions identified for the food load 14, the controller may access a memory and/or a database to retrieve properties (e.g. an acceptability curve and quality parameters 48) for the food type indicated (76). With the properties of the food type, the controller may continue by calculating cooking data based on the proportions indicated for the food load 14 and generating the range of available cooking times to achieve the predetermined quality level (78). The method 70 may then continue by receiving a selected cook time corresponding to the range of available cooking times to achieve the predetermined quality level (80).

The method 70 may gather the user specified cooking time in a variety of ways. For example, in some embodiments the controller of the cooking system 10 may output a range of available cooking times on the display screen 20 in response to receiving the selection of the food type and proportions in step 74. In some embodiments, the controller of the cooking system 10 may simply request a desired cooking time and determine in step 82 if the desired cooking time is within the available cooking times associated with the predetermined quality level. If the desired cooking time is not within the available for a predetermined quality level, the controller of the cooking system 10 may output a prompt for an updated input of the desired time (84). If the desired cooking time is within the available cooking times, the method 70 may continue to step 86 by controlling the heating apparatus 12 to heat the food load 14 over the desired cooking time. Finally, in step 88, the cooking process may be completed when the desired cooking time has elapsed. Accordingly, the cooking system 10 may provide for preparation of the food load 14 to a desired quality level while allowing a user to specify a cooking time over which the food load 14 is to be prepared.

Figure 6:
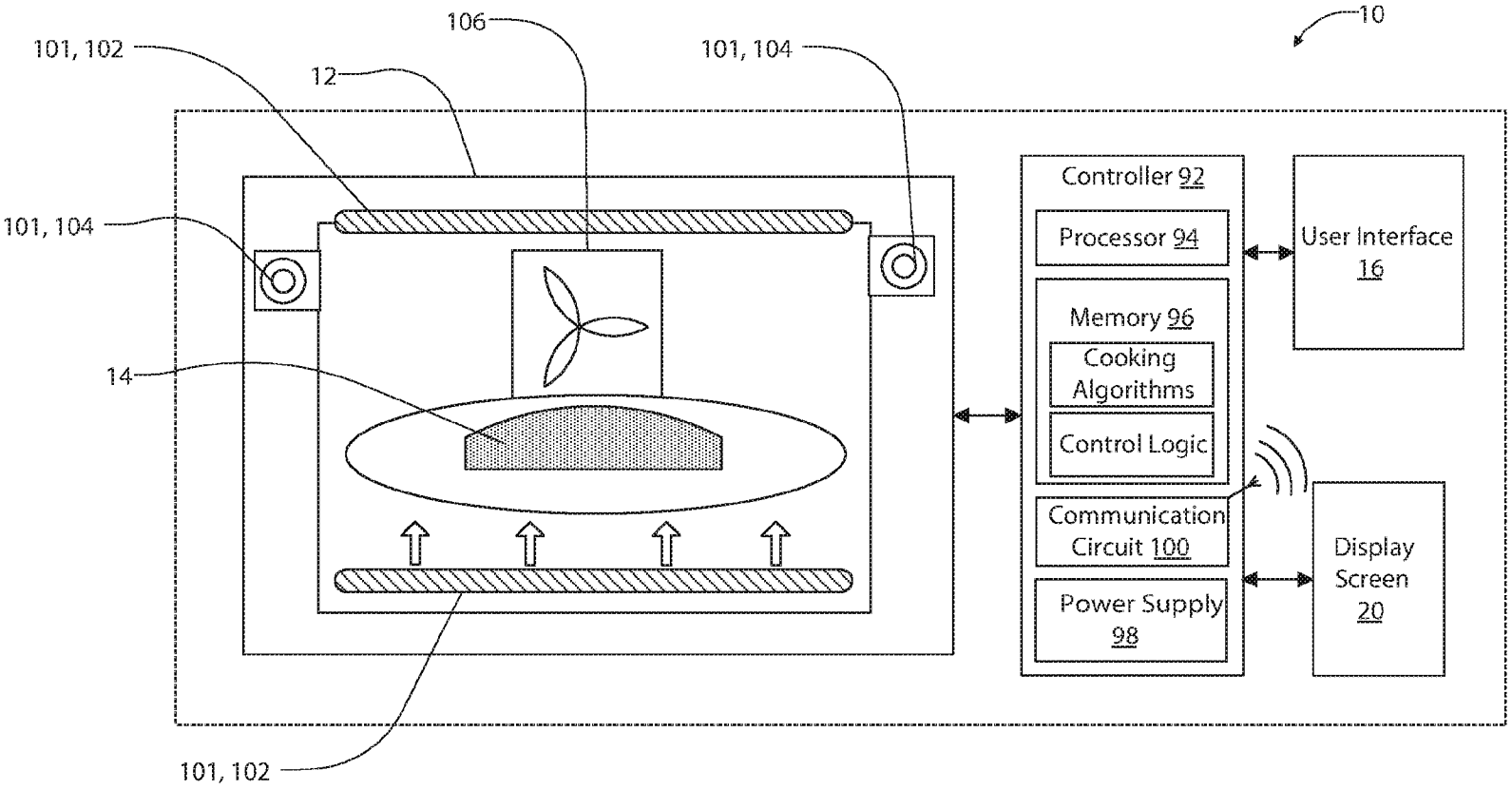
FIG. 6 is a block diagram of a cooking system in accordance with the disclosure.

Referring now to FIG. 6, a block diagram of the cooking system 10 is shown. As previously discussed, the cooking system 10 may comprise a controller 92, which may be configured to control the cooking apparatus 12. The controller may comprise a processor 94 and a memory 96. The processor 94 may correspond to one or more circuits and/or processors configured to communicate with the user interface 18 and access the various cooking algorithms and control logic via the memory 96. In this configuration, the controller 92 may be operable to control the heating sources of the cooking apparatus 12. The cooking algorithms and control logic stored in the memory 96 may include a wide variety of acceptability curves including the quality parameters 48. Additionally, the memory 96 may comprise instructions for a variety of scaling and/or arithmetic operations that may be configured to adjust the acceptability curves and quality parameters 48 based on a proportion of a specified food type.

The controller 92 may be supplied electrical current by a power supply 98 and may further comprise a communication circuit 100. The communication circuit 100 may correspond to various wired and/or wireless communication devices through which the controller 92 may communicate and/or access information stored in a remote server or location. For example, the communication circuit 100 may correspond to a local area network interface and/or a wireless communication interface. The wireless communication interface may be configured to communicate through various communication protocols including but not limited to wireless 3G, 4G, Wi-Fi®, Wi-Max®, CDMA, GSM, and/or any suitable wireless communication protocol. In this configuration, the controller 92 of the cooking system 10 may be configured to access information (e.g. quality parameters 48) for a wide variety of food types.

The cooking apparatus 12 may comprise various forms of heat sources 101 including, but not limited to a browning or heating element 102, a microwave element 104, a convection fan 106, or any mechanism suitable to heat food as discussed herein. The browning or heating element 102 may correspond to a gas burner, an electrically resistive heating element, an induction heating element, a browning or ferritic heating element or any other suitable heating device. Depending on the specific parameters of a requested quality level or quality parameter 48, the controller 92 may selectively control one or more of the heat sources 101 such that the food load 14 is prepared to a desired quality level over a user specified cooking time.

As discussed herein, the cooking system 10 may provide for a novel approach to preparing a food load wherein the cooking system adjusts various parameters in order to prepare the food load 14 over a user requested or desired time period. Accordingly, the disclosure may provide for various improvements for cooking systems and methods to ensure preparation of a food load to a predetermined quality level while allowing a user to request a desired cooking time.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A cooking system configured to prepare a selected food over a desired time period comprising:

a heating cavity comprising a heating apparatus;

a user interface configured to receive a user input defining the selected food; and a controller in communication with the heating apparatus and the user interface, the controller configured to:

access a cooking database for the selected food;

display a range of available times for the desired time period according to the cooking database, wherein the available times identify cooking times available for the selected food to achieve a first quality level of cooking preparation;

receive a selection of the desired time period from the user interface;

in response to the desired time period being outside a first predetermined time range for the first quality level, output an indication that the desired time corresponds to a second quality level; and control the heating apparatus to heat a food load to prepare the selected food to the second quality level in the desired time.

2. The cooking system according to claim 1, wherein the cooking database corresponds to a plurality of quality results designating a plurality of predetermined time ranges for the first quality level and the second quality level for a plurality of food types.

3. The cooking system according to claim 2, wherein the predetermined time ranges correspond to cooking times at which a cooking algorithm indicates that the selected food is prepared to one of the first quality level and the second quality level.

4. The cooking system according to claim 3, wherein the cooking algorithm comprises a plurality of power levels corresponding to the cooking times, wherein the power levels are derived from experimental results for a plurality of food types from which the selected food is identified by the selection.

5. The cooking system according to claim 3, wherein the cooking algorithm defines a range of available times and corresponding power levels to be applied by the controller to control the heating apparatus thereby consistently heating the selected food to each of the first quality level and the second quality level over the range of available times.

6. The cooking system according to claim 1, wherein the heating apparatus comprises a microwave element and a browning element.

7. The cooking system according to claim 6, wherein the controller is further configured to control a power level of each of the microwave element and the browning element to vary the cooking time over the range of available times while maintaining the first quality level.

8. The cooking system according to claim 7, wherein the power level corresponds to at least one of a microwave power level, a duty cycle of a heating element, and a temperature set point of the heating apparatus.

9. The cooking system according to claim 1, wherein each of the first quality level and the second quality level correspond to at least one of a level of temperature, consistency, and a moisture for the selected food in a prepared condition.

10. A method for heating a food over a desired time period comprising:

receiving a selected food type from a plurality of food types;

receiving a desired cook time for preparation of the selected food type;

comparing the desired cook time to a range of available cook times, wherein the available cook times identify cooking times for the selected food to achieve a predetermined quality level;

controlling a heating apparatus to heat a food load corresponding to the selected food type to the predetermined quality level in the desired cook time.

11. The method according to claim 10, further comprising:

accessing the range of available cook times from cooking data designating the range of available cook times and corresponding cooking parameters.

12. The method according to claim 11, wherein the available cook times and corresponding cooking parameters comprise experimental results indicating the available cook times and the corresponding cooking parameters configured to prepare the selected food type to the predetermined quality level.

13. The method according to claim 10, wherein the predetermined quality level corresponds to an indication of a minimum level of quality for preparation of the food load over the range of available cook times.

14. The method according to claim 10, further comprising:

in response to the desired cook time being outside the range of available cook times, displaying the range of available times thereby prompting the desired cook time within the range of available times.

15. The method according to claim 10, wherein the controlling of the heating apparatus comprises adjusting at least one of a cooking power, a duty cycle, and a set point temperature such that the food load is heated to the predetermined quality level in the desired time.

16. The method according to claim 10, further comprising:

calculating an extended cook time or a decreased cook time to heat the food load to achieve the predetermined quality level over the desired cook time.

17. The method according to claim 16, wherein the extended cook time and the decreased cook time are calculated by adjusting a rate of energy transfer from one or more of the heating sources of the cooking apparatus to the food load achieving the predetermined quality level over the desired cook time.

18. A cooking system configured to prepare a selected food over a desired time period comprising:

a heating cavity comprising a heating apparatus;

a user interface configured to receive a user input defining the selected food; and a controller in communication with the heating apparatus and the user interface, the controller configured to:

receive a selection of a selected food identifying a food load;

receive the desired time period from the user interface;

access a cooking database comprising a plurality of food types based on the selection;

compare the desired time period to a range of available times indicated in the cooking database, wherein the available times are predetermined to prepare the food load to a minimum quality level; and control the heating apparatus to heat the food load and prepare the selected food to at least the minimum quality level in the desired time.

19. The cooking system according to claim 18, wherein in response to the desired time period being outside the range of available cooking times, the controller is further configured to output a prompt for an updated time period and indicate the available times.

20. The cooking system according to claim 19, wherein the controlling the heating apparatus comprises controlling the heating apparatus to complete a cooking routine indicated in the cooking database, wherein the cooking routine is preconfigured in the cooking database to prepare the selection identifying the food load to the minimum quality level over the desired time period.

* * * * *